US011781845B2

(12) United States Patent
Diaz Garcia et al.

(10) Patent No.: US 11,781,845 B2
(45) Date of Patent: Oct. 10, 2023

(54) SAFE TRANSPORT OF SHAPED CHARGES

(71) Applicant: Schlumberger Technology Corporation, Sugar Land, TX (US)

(72) Inventors: Cesar Diaz Garcia, Houston, TX (US); David Damm, Houston, TX (US); Scott Malone, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/284,659

(22) PCT Filed: Oct. 10, 2019

(86) PCT No.: PCT/US2019/055601

§ 371 (c)(1),
(2) Date: Apr. 12, 2021

(87) PCT Pub. No.: WO2020/142128

PCT Pub. Date: Jul. 9, 2020

(65) Prior Publication Data

US 2021/0356241 A1 Nov. 18, 2021

Related U.S. Application Data

(60) Provisional application No. 62/743,631, filed on Oct. 10, 2018.

(51) Int. Cl.
*F42B 39/24* (2006.01)
*F42B 39/14* (2006.01)
(Continued)

(52) U.S. Cl.
CPC ..... *F42B 39/14* (2013.01); *F42B 39/24* (2013.01); *F42B 1/02* (2013.01); *F42B 39/26* (2013.01)

(58) Field of Classification Search
CPC .... F42B 1/00; F42B 1/02; F42B 1/024; F42B 1/028; F42B 3/08; F42B 39/00;
(Continued)

(56) References Cited

U.S. PATENT DOCUMENTS 4,389,947 A 6/1983 King et al.
6,454,085 B1 * 9/2002 Barker ..... F42B 39/14 53/446
(Continued)

FOREIGN PATENT DOCUMENTS

DE 102009031443 A1 * 1/2010 ..... F42B 39/14
WO 0068635 A2 11/2000
WO 2017116581 A1 7/2017

OTHER PUBLICATIONS

Machine translation of DE 10 2009 031 443 A1 (Year: 2010).*
(Continued)

*Primary Examiner* — James S Bergin
(74) *Attorney, Agent, or Firm* — Jeffrey D. Frantz

(57) ABSTRACT

A shaped charge is described herein, comprising a case; an energetic material disposed in the case; a metallic liner with a first surface disposed in contact with the energetic material and a second surface that is opposite from the first surface, and that defines a cavity; and an attenuator disposed in the cavity.

20 Claims, 11 Drawing Sheets

(51) Int. Cl.
*F42B 1/02* (2006.01)
*F42B 39/26* (2006.01)

(58) Field of Classification Search
CPC ..... F42B 39/14; F42B 39/20; F42B 39/22; F42B 39/24; F42B 39/26
USPC ..... 102/306, 307, 309
See application file for complete search history.

(56) References Cited

U.S. PATENT DOCUMENTS

| | | | | |
|---|---|---|---|---|
| 6,629,597 | B2 * | 10/2003 | Barker | F42B 39/14 53/446 |
| 7,416,076 | B2 * | 8/2008 | Barton | F42B 39/00 206/593 |
| 10,914,563 | B2 * | 2/2021 | McNelis | F42B 39/14 |
| 11,215,040 | B2 * | 1/2022 | Baumann | E21B 43/116 |
| 2005/0150781 | A1 | 7/2005 | Barton et al. | |

OTHER PUBLICATIONS

Claude E. Cooke, "Fracturing With a High-Strength Proppant", Journal of Petroleum Technology, 29 (10): 1222-1226 (Year: 1977).*
International Search Report and Written Opinion issued in the PCT Application PCT/US2019/055601, dated Jul. 2, 2020 (7 pages).
International Preliminary Report on Patentability issued in the PCT Application PCT/US2019/055601 dated Apr. 22, 2021, 6 pages.

* cited by examiner

SAFE TRANSPORT OF SHAPED CHARGES

CROSS-REFERENCE TO RELATED APPLICATIONS

This application claims benefit of U.S. Provisional Patent Application Ser. No. 62/743,631 filed Oct. 10, 2018, which is incorporated herein by reference.

BACKGROUND

In general, the disclosure describes an apparatus and method for the safe transport of shaped charges. The method and apparatus of the present disclosure may enable shaped charges with high explosive load to be transported via commercial air transportation.

DESCRIPTION OF THE RELATED ART

When a hydrocarbon well is drilled, a casing may be placed in the well to line and seal the wellbore. Cement is then pumped down the well under pressure and forced up the outside of the casing until the well column is also sealed. This casing process ensures that the well is isolated, and prevents uncontrolled migration of subsurface fluids between different well zones, and provides a conduit for installing production tubing in the well. However, to connect the inside of the casing and wellbore with the inside of the formation to allow for hydrocarbon flow from the formation to the inside of the casing, holes are formed throughout the casing and into the wellbore. This practice is commonly referred to as perforating of the casing and formation. Open-hole wells are also possible, i.e., where a casing is not used and jetting, fracturing or perforation is directly applied to the formation.

During the perforating process, a gun-assembled body containing a plurality of shaped charges is lowered into the wellbore and positioned opposite the subsurface formation to be perforated. Initiation signals are then passed from a surface location through a wireline or tubing holding the shaped charges to one or more blasting caps located in the gun body, thereby causing detonation of the blasting caps. The exploding blasting caps in turn transfer a detonating wave to a detonator cord which further causes the shaped charges to detonate. The detonated shaped charges form an energetic stream of high-pressure gases and high velocity particles, which perforates the well casing and the adjacent formation to form perforation tunnels. The hydrocarbons and/or other fluids trapped in the formation flow into the tunnels, into the casing through the orifices cut in the casing, and up the casing to the surface for recovery.

For purposes of transporting shaped charges to the location of the well to be perforated, shaped charges are provided an explosive shipping classification. For instance, the United Nations provides hazard classification codes that dictate the available modes of transportation. Currently heavy loaded shaped charges are given a hazard classification of 1.1D, which is given to primary explosive devices that may only be transported by land and sea. The inability to transport shaped charges through the air increases both the cost and the time needed to transport the shaped charges to the well-site.

What is needed is an improved, method and apparatus for the safe transport of shaped charges with a hazard classification that enables air transport.

SUMMARY

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limited the scope of the claimed subject matter.

Embodiments described herein provide a shaped charge comprising a case; an energetic material disposed in the case; a metallic liner with a first surface disposed in contact with the energetic material and a second surface that is opposite from the first surface, and that defines a cavity; and an attenuator disposed in the cavity.

Another embodiment provides a packaging system for shaped charges, comprising two partition portions defining a plurality of receptacles for shaped charges, the two partition portions separated by one or more containment plates; and a plurality of attenuators for disposing an attenuator in the cavity of each shaped charge.

Another embodiment provides a method of transporting shaped charges, comprising placing an attenuator comprising one or more bodies having a hardness of at least about C60 within the cavity of each shaped charge; and placing the shaped charge in a package having shock absorbing members.

BRIEF DESCRIPTION OF THE DRAWINGS

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
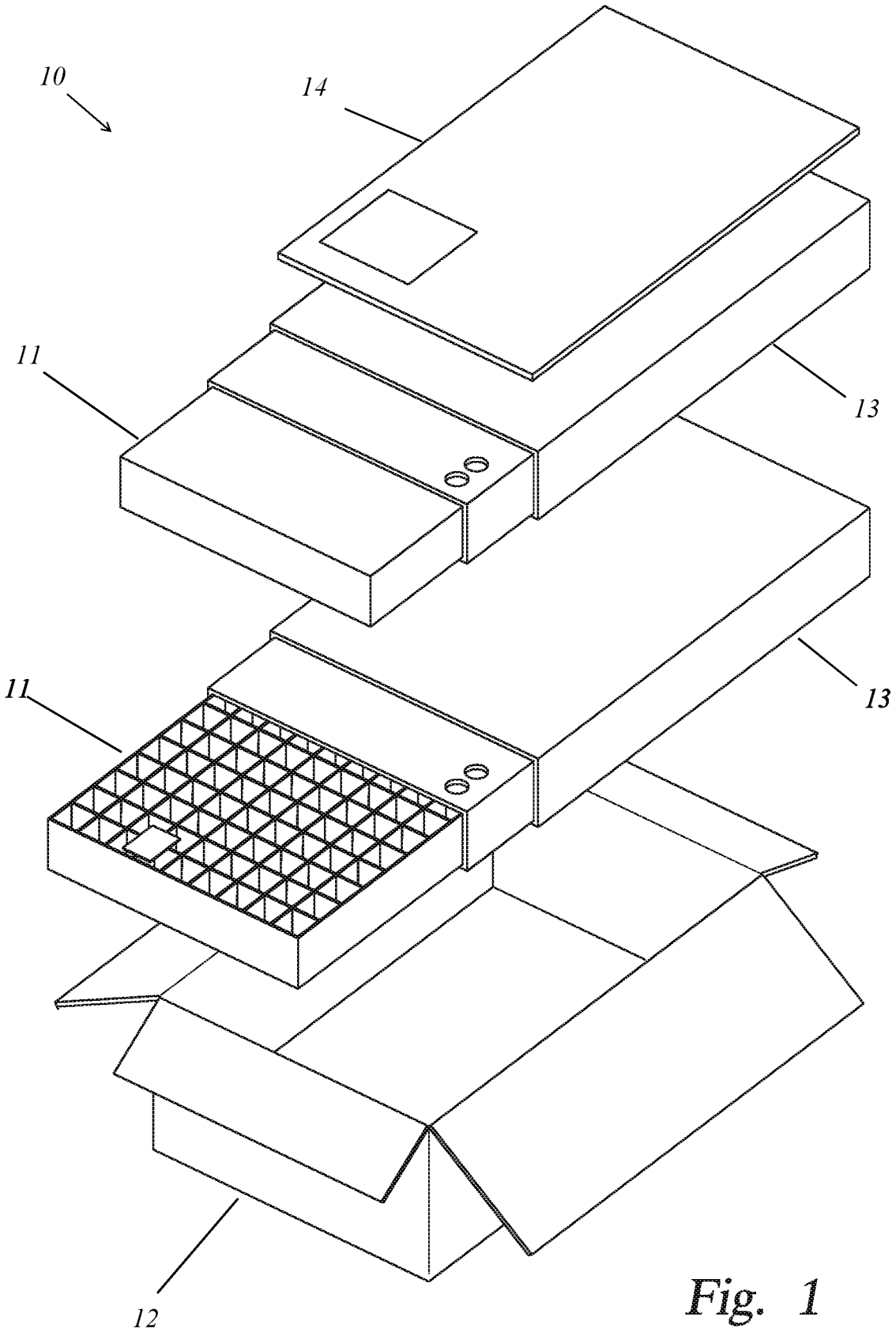
Fig. 1 (PRIOR ART)
FIG. 1 is an illustration of current, prior art, packaging of shaped charges.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. As used herein, the terms "coils", "pipes", and "tubes" are used individually or in combination to mean the internal fluid carrying elements of a fired heater.

The present disclosure generally relates to an apparatus and method for the safe transport of shaped charges. More specifically, the present disclosure provides a method and apparatus that enables shaped charges to be given a hazard classification of 1.4D for charges having up to 75 grams of explosive. With this 1.4D classification, even heavy charges (up to 75 grams of explosive) may be transported by commercial air transportation, thus reducing the time and cost associated with transporting the shaped charges by land and sea.

Currently, the packaging of high explosive load shaped charges results in a hazard classification of 1.1D, which restricts transport to land and sea. An example of current packaging is shown in FIG. 1. As will be discussed herein, the packaging, referred to generally as 10, shown in FIG. 1 does not comprise the jet interrupters of the present disclosure nor does the packaging 10 comprise the shields of the present disclosure to protect the charges and to dampen any detonation shockwave. If a shaped charge inadvertently detonates in the packaging 10 of FIG. 1, there would be induced damage in the axial direction of the forming jet, typically a hole in the protective material. In FIG. 1, shaped charges are disposed in cubicles of a partition tray 11. Two partition trays 11 holding shaped charges are packed into a box 12. The two partition trays 11 are packed in the box 12 facing each other. Each partition tray 11 is individually inserted into a tray box 13, which is closed, and the tray boxes 13 are packed into the box 12. A top sheet 14 may be overlaid in the top of the packaging structure. The two partition trays 11 and tray boxes 13 are substantially identical, and nothing but the material of the tray boxes 13 separates the shaped charges in one partition tray 11 from the shaped charges in the other partition tray 11.

Figure 2:
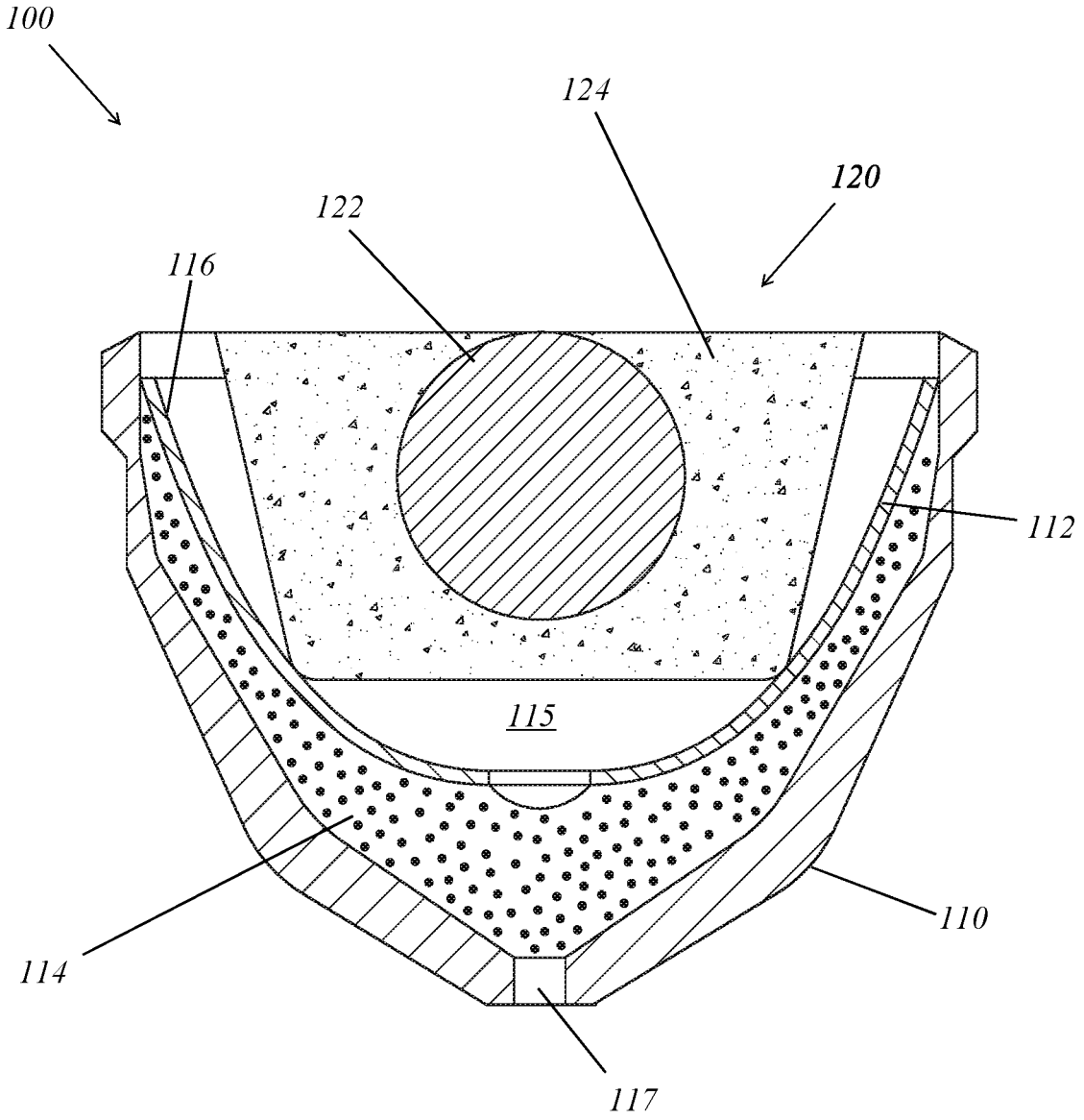
FIG. 2 provides a side sectional view of an attenuator according to one embodiment.

FIG. 2 provides a side sectional view of an embodiment of the present disclosure. As shown, the shaped charge 100 comprises the case 110, the metallic liner 112, and the explosive 114, all of which are generally shaped to define a cavity 115 within a concave surface 116 of the metallic liner 112. An opening 117 formed through the various layers of the shaped charge 100 provides access for discharge energizers such as electrical or ballistic energy sources. The shaped charges described herein are provided with attenuators that reduce, disrupt, or otherwise mitigate energy from discharge of the explosive material of the shaped charge. The attenuators may function as a jet interrupter that prevents a jet of energetic gas and particles from forming upon discharge of the explosive. Here, the attenuator is a jet interrupter 120. The jet interrupter 120 is comprised of a hardened steel ball 122 and concrete 124. It should be understood that the materials of the components of the jet interrupter 120 are not limited to steel and concrete as other materials may provide suitable protections from inadvertent detonation and remain within the purview of this invention. It should be further understood that although the shaped charge 100 shown in FIG. 2 is a big hole shaped charge having a high content of explosives, the present disclosure can also be used with shaped charges having a lower content of explosives, and deep penetrating charges made with solid metal conical liners and charges with powdered metal liners. Any shaped charges having the generally cup-shaped construction described herein could benefit from the use of the present concepts. Also, as will be further described below, other attenuator designs can be used.

In embodiments of the present disclosure, when the shaped charge 100 is detonated by an external ballistic transfer, the explosive 114 inside the charge 100 creates a shockwave that propagates and makes the shaped charge liner 112 collapse, forming a jet. The jet of the shaped charge 100 attempts to form but when it strikes the hardened steel ball 122 it is not capable of forming a jet that penetrates the adjacent object. Moreover, the jet interrupter 120 is located inside the shaped charge cavity 115. During discharge, the jet tends to form near the central conical axis of the cavity 115. The hardened steel ball 122 is positioned to occupy much of the central axial area of the cavity 115, which restricts formation of the jet and mitigates projection of energy by the shaped charge 100. The concrete 124 can be shaped to fill the inside of the shaped charge 100, and to position the steel ball 122 centrally within the cavity 115 to perform the function of interrupting formation of the jet. Due to the wide range of sizes of shaped charges 100, concrete 124 works to accommodate a wide variety of shapes while holding the hardened steel ball 122 in the center of the axis of the liner 112.

In addition to the effectiveness of minimizing damage to the surroundings, embodiments of the present disclosure are cost effective. The cost of the hardened steel balls 122 and concrete 124 is relatively low compared to other more elaborated or customized types of packaging. Additionally, due to the 1.4D classification, it is not needed to charter private airplanes to deliver the shaped charges 100 in a timely manner since the new packaging is suitable for air cargo transportation which is provided by commercial carriers.

Figure 3:
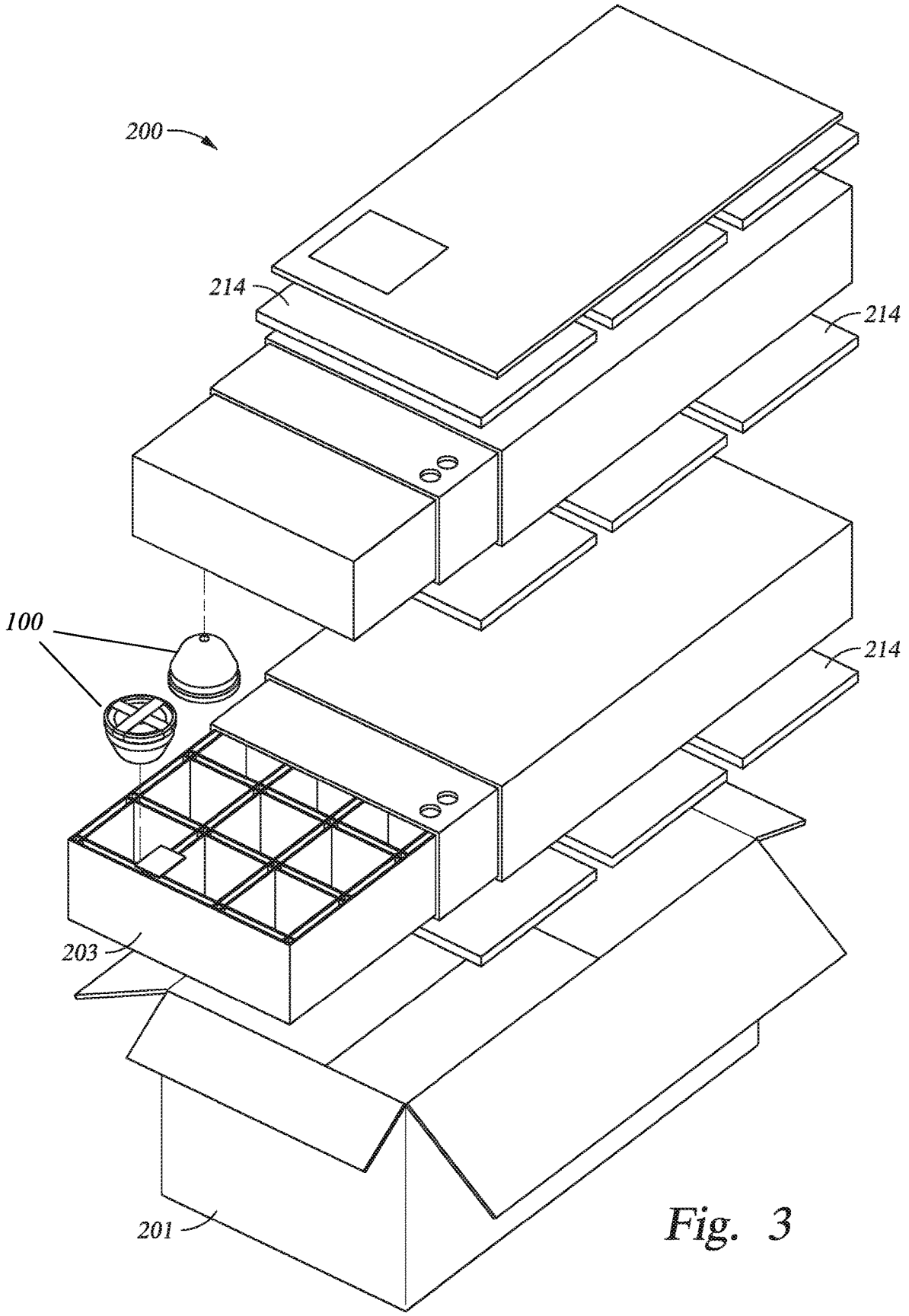
FIG. 3 illustrates a packaging system according to one embodiment.

Referring to FIG. 3, an embodiment of the packaging of the present disclosure is shown in exploded view. The packaging of the present disclosure, referred to generally as 200, comprises a box 201 that allows the containment of three layers of chipboards 214 and two trays 203 to hold shaped charges. Chipboards are commercially available sheets of wood particles and/or paper pressed and/or adhered together into a sheet or board. Here, there are three chipboards 214 in each of the three layers, for a total of nine chipboards 214. The trays 203 used are the standard cardboard trays used in the prior art packaging 10 (FIG. 1). Two trays 203 are shown in FIG. 3, with the open receptacles facing one another, so the receptacles of the top tray 203 are not visible. The chipboards 214, not present in the prior art packaging 10, act to provide shockwave absorption. It should be noted that each layer of three chipboards 214 could be one large chipboard, so the packaging of FIG. 3 could have one chipboard below the bottom tray of shaped charges, one chipboard between the two trays of shaped charges, and one chipboard on top of the top tray of shaped charges, for a total of three chipboards instead of the nine chipboards shown. The chipboards 214 and trays 203 form a containment structure to reduce propagation of energy from a shaped charge that inadvertently discharges. As in the prior art packaging 10, the shaped charges 100 from the top tray should face down and the charges 100 in the bottom tray should face up while inside the box 201, with the charges 100 of both trays facing each other. If each shaped charge 100 is opposed by another shaped charge 100, there will be an even number of shaped charges 100 in the box 201. Inside every shaped charge 100 there should be a jet interrupter 120 (FIG. 2) which will disrupt the jet formation of the shaped charge liner 112 if such event would occur at any time, or other attenuator to mitigate energy propagation in the event of discharge.

As has been described above, embodiments of the present disclosure provide an innovative way of packaging shaped charges 100. The attenuators described herein negate the function of the shaped charge 100 which is to project kinetic energy to penetrate an object. In addition to the attenuator, the packaging 200 is provided with thick chipboard pads 214 that help in reducing the hazard classification of shaped charges 100 for transportation purposes.

As has been discussed, the attenuators and the packaging 200 of the present disclosure enable a 1.4D shipping classification for high explosive load shaped charges 100. To acquire the 1.4D classification, guidelines have been established for test methods relating to explosives. The United Nations Section 16 Series 6 (Recommendations on the Transport of Dangerous Goods, Fifth Rev. Ed., UN 2009, pp. 143 ff) contains the guidelines for such tests. These guidelines provide the following criteria: (a) no crater at the test site, (b) no damage to the witness plate, (c) no mass detonation, and (d) whether a blast can be measured.

A stack test of the present disclosure was performed with two boxes of charges and a witness plate in the bottom of the stack. Upon discharge of a charge in the stack, it was observed that there was no damage to the witness plate. Such result meets two points of the criteria to acquire the 1.4D classification. There was no crater at the test site and no damage to the witness plate. Additionally, since only the charge that was intentionally detonated went off and none of the rest, this is considered as no mass detonation. Moreover, all the charges remained within the confining material (sandbags) that were surrounding the two boxes of charges. This means that the blast distance is very small, and it is within the 1.4D criteria. The section 16 series 6 (a) (b) & (c) tests were conducted on shaped charges with 75 grams of explosives content.

Figure 4A:
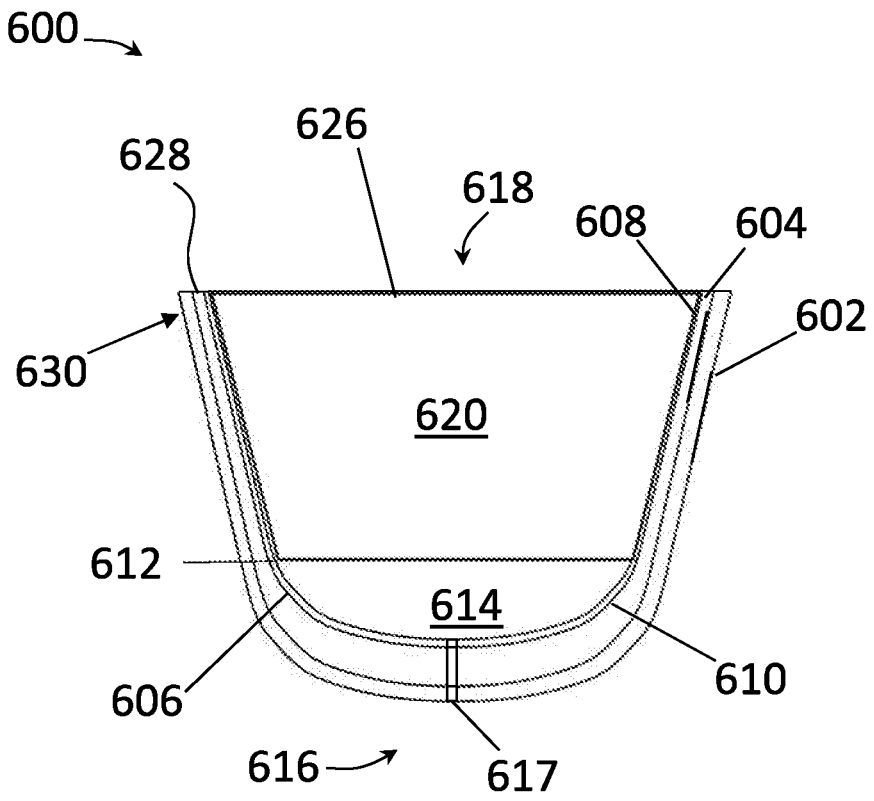
FIGS. 4A-4E are cross-sectional view of attenuators according to several embodiments.

FIGS. 4A-4D show embodiments of shaped charges having attenuators. Such shaped charges, with installed attenuators, can satisfy UN section 16, series 6, and DOT 1.4D regulations allowing air transport. FIG. 4A shows a cross-sectional view of a shaped charge 600 that comprises a case 602, an energetic material 604 disposed on the concave surface of the case 602 and forming a concave surface 606 of the energetic material 604, and a metal liner 608 disposed on the concave surface 606 of the energetic material 604. A first surface 610 of the metal liner 608 contacts the concave surface 606 of the energetic material 604, and a second surface 612 of the metal liner 608 defines a cavity 614 of the shaped charge 600. The shaped charge 600 has a vaguely conical shape with a narrow end 616 that is closed except for a small opening 617 to provide activation energy, and a wide end 618 that is open (except when an attenuator is installed that blocks the opening, as described below) to allow energetic gases and particles from the shaped charge to escape upon activation. The shaped charge 600 is circular in cross-section, and the side of the shaped charge 600 tapers inward from the wide end 618 to the narrow end 616. The side may taper substantially linearly for all or part of its length from the wide end 618 to the narrow end 616 or may curve somewhat in a cup shape. The cavity 614 of the shaped charge 600 is thus substantially surrounded or encompassed by the energetic material 604 and the metal liner 608. When the energetic material is activated, energetic gases and particles are propelled toward a central axis of the shaped charge 600 within the cavity 614 to form a jet which exits the cavity 614 to perforate a formation.

An attenuator 620 is located in the cavity 614 to attenuate the energy of the energetic gases and particles of the shaped charge 600, reducing the discharge energy of the gases and particles. In some cases, the attenuator 620 disrupts formation of the jet, functioning essentially as a jet interrupter. In other cases, the attenuator 620 merely reduces potency, focus, velocity, or temperature of the gases and particles. To attenuate the energetic gases and particles, the attenuator 620 occupies at least about 50% of the volume of the cavity 614 providing a hard, dense material at the location where a jet of energetic gases and particles would form in the cavity 614 or generally blocking expulsion of energetic materials from the shaped charge. The hard, dense material alters the trajectory of the energetic gases and particles, reducing focus, potency, velocity, and/or temperature of the energetic gases and particles.

The attenuator 620 typically has a hardness measurable on the Rockwell C scale. Materials having Rockwell hardness of at least about C60 work well, but materials of lower Rockwell C hardness can also be used, either for the full attenuator or a component thereof such as a ball captured within the attenuator. Materials that can be used include zirconia (~55), hardened steel (~C60), alumina (~C77), tungsten carbide (~C75), silicon nitride (~C70), gold (~C10), platinum (~C40), and tungsten metal (~C30). Rockwell C hardness can be tested using ASTM methods E18 and E110. ISO 6508 is another standard method for Rockwell hardness testing. For lower hardness materials, higher density can also be helpful in the attenuator 620. Density provides inertia to prevent or minimize propulsion of the attenuator 620 by the energetic gases and particles.

The attenuator 620 may be a homogeneous body or a heterogeneous body having two or more members. In one case, the attenuator 620 is a cement body with a hardened steel ball embedded therein. In another case, the attenuator is a hard, dense, homogeneous material such as steel powder dispersed in cement or dense polymer. The dense polymer can be a shock resistant polymer such as Kevlar, polypropylene, polyethylene, or hard rubber. The attenuator 620 is typically molded, for example by placing a hard, dense body such as a hardened steel ball into a mold and molding a material capable of containing the hard, dense body, such as the cement or polymers described above, around the hardened steel ball. For a homogeneous attenuator, a hardening material, such as steel powder, can be dispersed within a solidifiable medium such as a cement precursor or polymerization precursor. The mixture thus formed is applied to a mold and solidified, or partially solidified. The resulting body is removed from the mold and, if necessary, allowed to completely solidify.

The attenuator 620 of FIG. 4A has a frustoconical shape that, at least partially, matches the interior shape of the cavity 614. Here, the attenuator 620 rests inside the cavity 614 in contact with the metal liner 608. In this case, the attenuator 620 takes up most of the cavity volume, allowing little room for propagation of energetic gases and particles and formation of a jet. The inertia of the dense attenuator resists displacement by the force of the energetic gases and particles, thus attenuating the kinetic energy of the gases and particles, and the thermal mass of the attenuator also absorbs some thermal energy from the energetic gases and particles. In this way, overall energy propagation by the energetic gases and particles is reduced, in turn reducing the likelihood that the energetic gases and particles will deliver activating energy to another shaped charge in the vicinity.

Figure 4B:
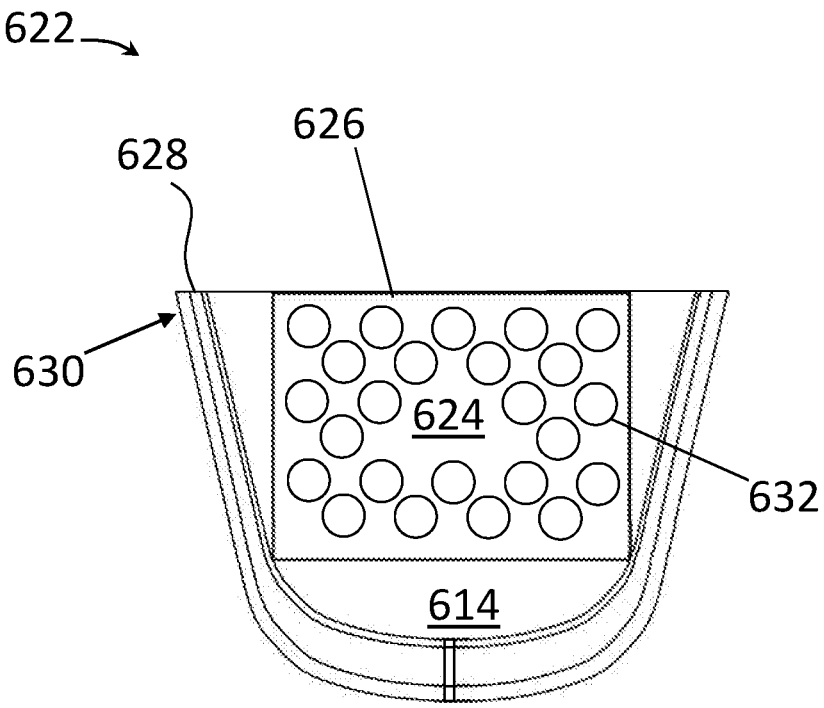

FIG. 4B shows a shaped charge 622 with an attenuator 624 that is a hard, dense first member impregnated with a plurality of hardened steel balls 632. In this case, the hardened steel balls 632 are situated in a structured arrangement within the first member, which is, as above, cement or a polymer that can contain the hardened steel balls. The attenuator 624 also rests inside the cavity 614 in contact with the metal liner 608. The attenuator 624 has a different shape from the attenuator 620. In this case, the attenuator 624 is cylindrical, but still occupies more than 50% of the volume of the cavity 614. Each of the attenuators 620 and 624 have an upper surface 626 that is at substantially the same elevation as an upper surface 628 at an edge 630 of the cavity 614, but the upper surface 626 of the attenuators 620 and 624 could be above or below the upper surface 628 of the cavity 614.

Figure 4C:
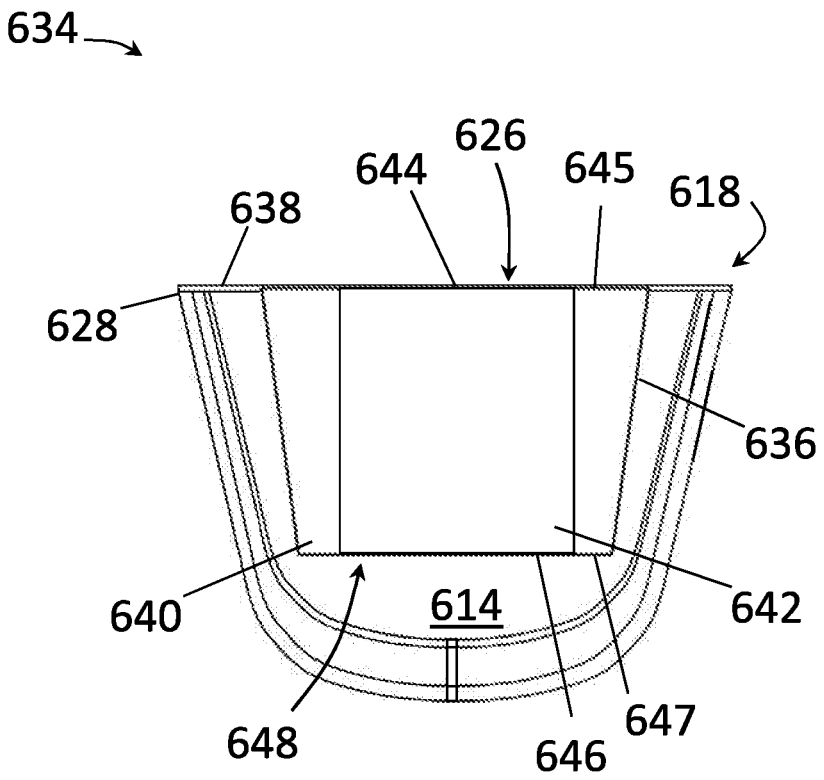

FIG. 4C shows a shaped charge 634 with an attenuator 636 that is suspended within the cavity 614. The attenuator 636 has an extension 638 at the wide end 618 that protrudes over the upper surface 628 of the cavity 614 and rests on the upper surface 628, thus suspending the attenuator 636 within the cavity 614. In this case, to illustrate the possibility of different shapes of attenuators, the attenuator 636 is a heterogeneous body with at least two members, here a first member 640 that variously engages with a second member 642. The second member 642 may be contained by the first member 640 in an interior of the first member 640, or the second member 642 may protrude partly out of the first member 640. In such embodiments, the first member 640 generally holds the second member 642 in a stable position.

The second member 642 typically has a higher density and hardness than the first member 640. In this case, the second member 642 has a cylindrical profile, with an upper surface 644 that forms part of the upper surface 626 of the attenuator and a lower surface 646 that forms part of a lower surface 648 of the attenuator 636. Here, the upper surface 644 of the second member 642 is substantially coplanar with an upper surface 645 of the first member 640, and the lower surface 646 of the second member 642 is substantially coplanar with a lower surface 647 of the first member 640. Thus, in this case, and in other cases of heterogeneous attenuators with first and second members, the second member 642 may be visible within the first member 640 or may protrude from the first member 640. The first member 640 is typically made of a hard or tough material, such as cement or polymer, that holds the second member 642 in place. The second member 642 is typically made of hard, dense material, as described above, to provide a dampening effect on energetic gases and particles generated by activation of the shaped charge 634.

Figure 4D:
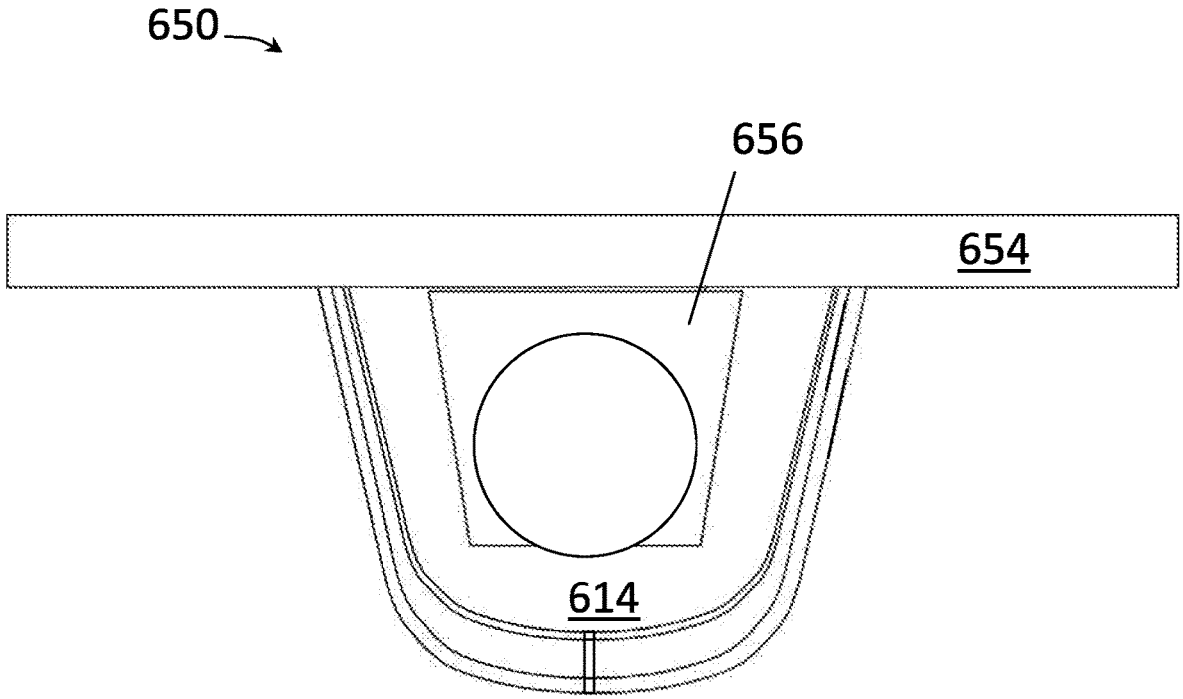
Figure 4E:
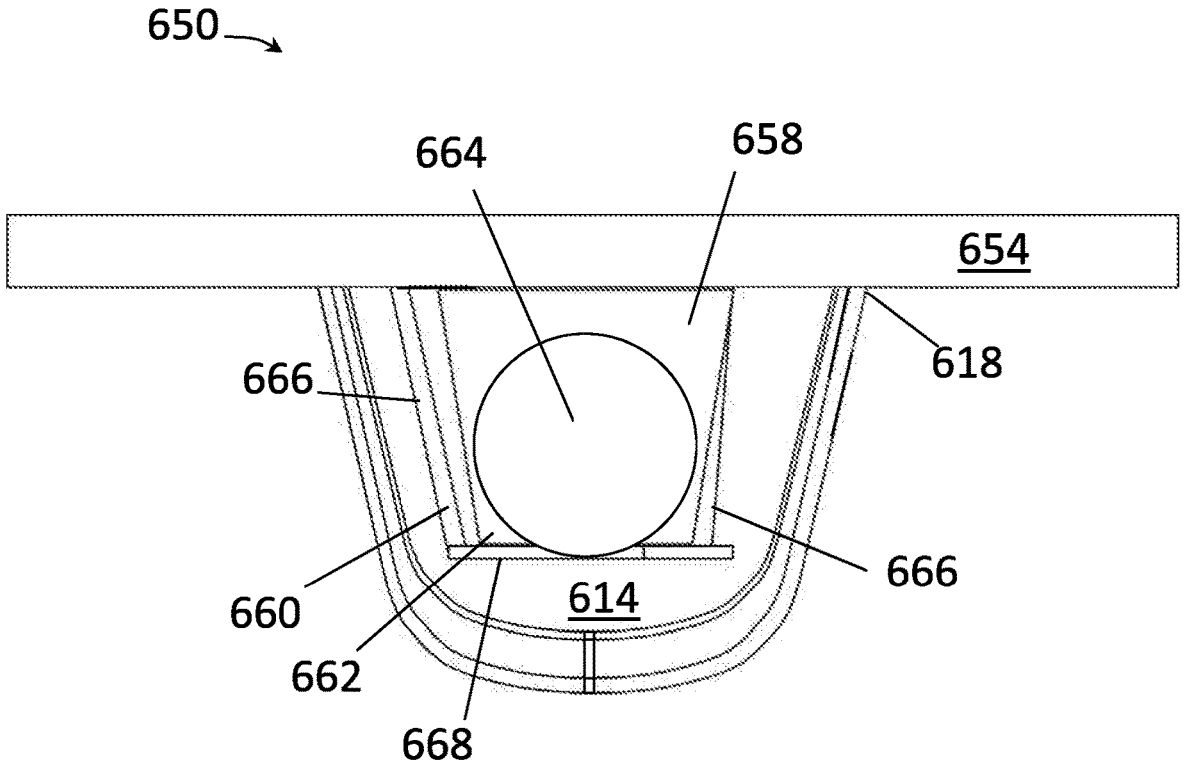

FIG. 4D shows a shaped charge 650 coupled with an attenuator 656 that is attached to a containment plate 654 used in packaging the shaped charge 650. The containment plate 654 may be a molded material, such as plastic, or may be a fiberboard or chipboard such as the chipboards 214 of FIG. 3. Positioning the containment plate 654 over the shaped charge 650 disposes the attenuator 656 in the cavity of the shaped charge 650. FIG. 4E shows the shaped charge 650 coupled with an attenuator 658 that uses a plastic cage 660 attached to, and protruding from, the containment plate 654. The attenuator 658, in this case, is a heterogeneous body with two members, a first member 662 that encompasses, at least partially, a second member 664. The second member 664 is hard and dense, for example hardened steel, while the first member 662 is a hard moldable material, such as cement, plastic, or hard rubber.

The plastic cage 660, in this case, has three prongs 666 that protrude from the containment plate 654 at locations along a circular perimeter at 120° angular displacements. In this cross-sectional view, the prong 666 in the foreground is removed. Following the shape of the shaped charge 650, the prongs extend toward each other and away from the containment plate 654 so that the prongs 666 can protrude deeply into the cavity 614 of the shaped charge 650. Each prong 666 ends with a restraint 668, which is an arc of a circle. The restraints 668 of the three prongs 666 abut together to form a ring. The prongs 666 and restraints 668 form a cage with a conical structure, following the general shape of the cavity 614. The attenuator 656, in this case, has a frustoconical shape that generally follows the shape of the cage 660 and the cavity 614.

The attenuator 656 is inserted into the cage 660. The plastic prongs 666 are formed to be flexible enough to separate the restraints 668 and insert the attenuator 656 into the cage. Once the attenuator 656 is inserted, the prongs 666 are released to return to their rest position, with restraints 668 abutting, or nearly so. The prongs 666 and restraints 668 hold the attenuator 656 in position, and when the containment plate 654 is positioned on the wide end 618 of the shaped charge 650, the attenuator 656 is positioned in the cavity 614.

In some cases, the containment plate 654, with plastic cage 660, can be molded as a single, integrally formed piece of plastic. A plurality of plastic cages 660 can be formed protruding from the containment plate 654 to accommodate a plurality of attenuators 658, one for each plastic cage 660. The entire containment plate 654, with plastic cages 660 and attenuators 658 deployed in the plastic cages 660, can be positioned with respect to a plurality of shaped charges 650 to provide attenuators 658 in the cavities 614 of all the shaped charges 650.

Figure 5A:
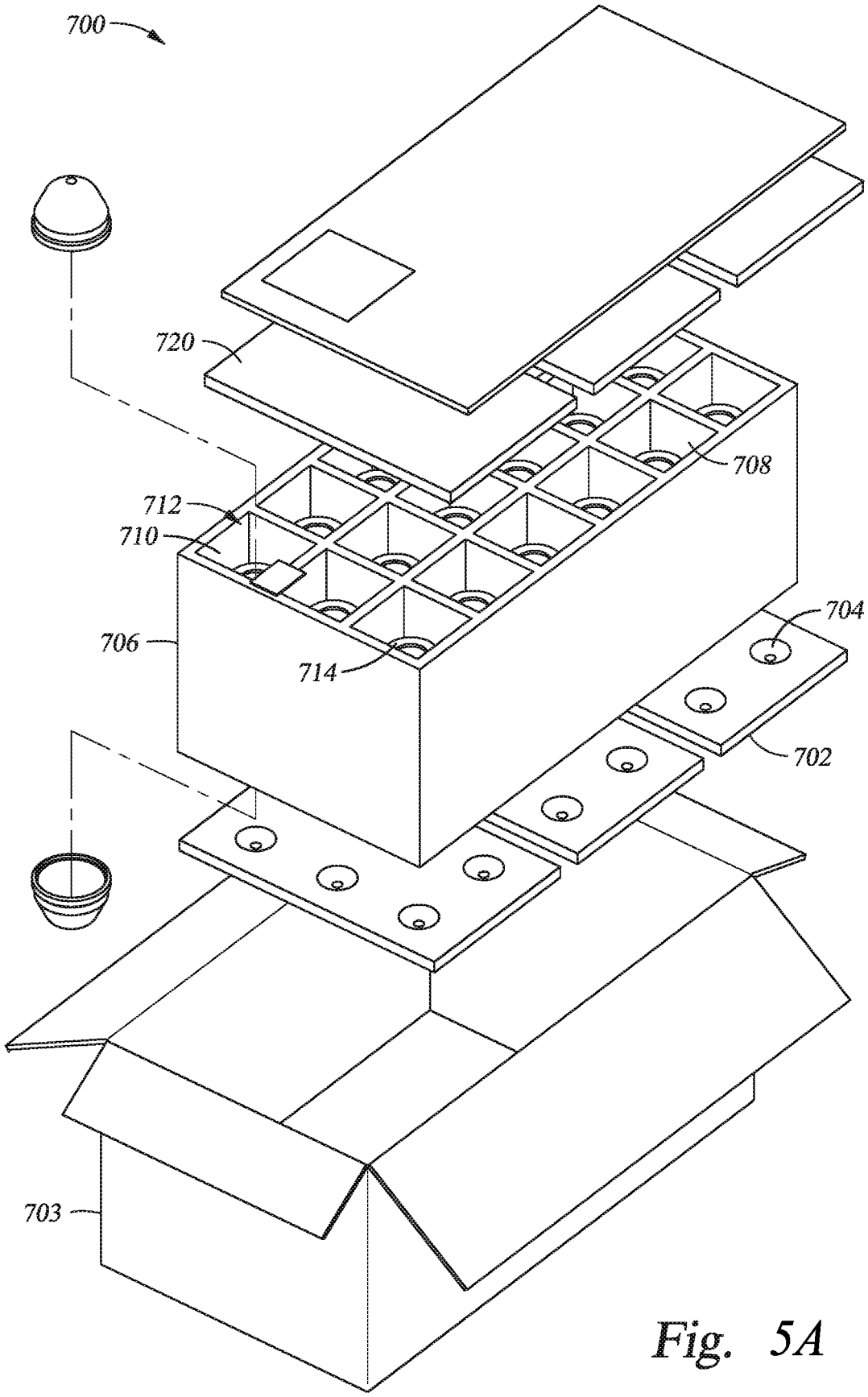
FIG. 5A illustrates a packaging system according to another embodiment.

FIG. 5A is an isometric view of a packaging system 700 for shaped charges according to one embodiment. The packaging system 700 utilizes attenuators in cages projecting from a containment plate, similar in concept to the attenuator structure shown in FIG. 4E. Like the packaging system of FIG. 3, the packaging system 700 includes two partition portions 708 separated by a containment plate (visible in FIG. 5B), and a plurality of attenuators for disposing an attenuator in the cavities of multiple shaped charges. In this case, however, the attenuators are housed in cages that are part of the packaging system 700. Here, the two partition portions 708 and the containment plate are molded as one integrally formed plastic frame, and the attenuator cages are plastic items, which can be molded, and which engage with the containment plate.

The packaging system 700 has a bottom tray 702 with a plurality of depressions 704 in an ordered array. Here, there are three bottom trays 702, but any number can be used. The depressions 704 receive the narrow end of shaped charges to be packaged into the packaging system 700. The bottom tray 702 may be plastic, chipboard, fiberboard, or other suitable material. The bottom tray 702 is typically placed into the bottom of a shipping container 703, such as a box, prior to deploying shaped charges into the bottom tray 702.

Once every desired depression 704 is provided with a shaped charge, narrow end down to allow the shaped charge to stand momentarily unsupported in the depression 704, an attenuator frame 706 is placed over the bottom tray 702. The attenuator frame 706 includes two partition portions 708 (shown further in FIG. 5B). Each partition portion 708 includes a plurality of partitions 710 defining a plurality of receptacles 712, each receptacle designed to house one shaped charge. Here, the receptacles 712 of only one partition portion 708 are visible because the other partition portion 708 is hidden in FIG. 5A. The two partition portions 708 are defined on opposite sides of a containment plate, which is not visible in FIG. 5A, but extends along a plane parallel to the bottom tray 702 and separates the two partition portions 708. Thus, the attenuator frame 706 includes receptacles 712 on top and bottom to fit shaped charges. Each receptacle 712 of both partition portions 708 has a cage 714, which can be the cage 660, or any convenient design of a cage. The cages 714 are designed to house an attenuator of appropriate design.

Figure 5B:
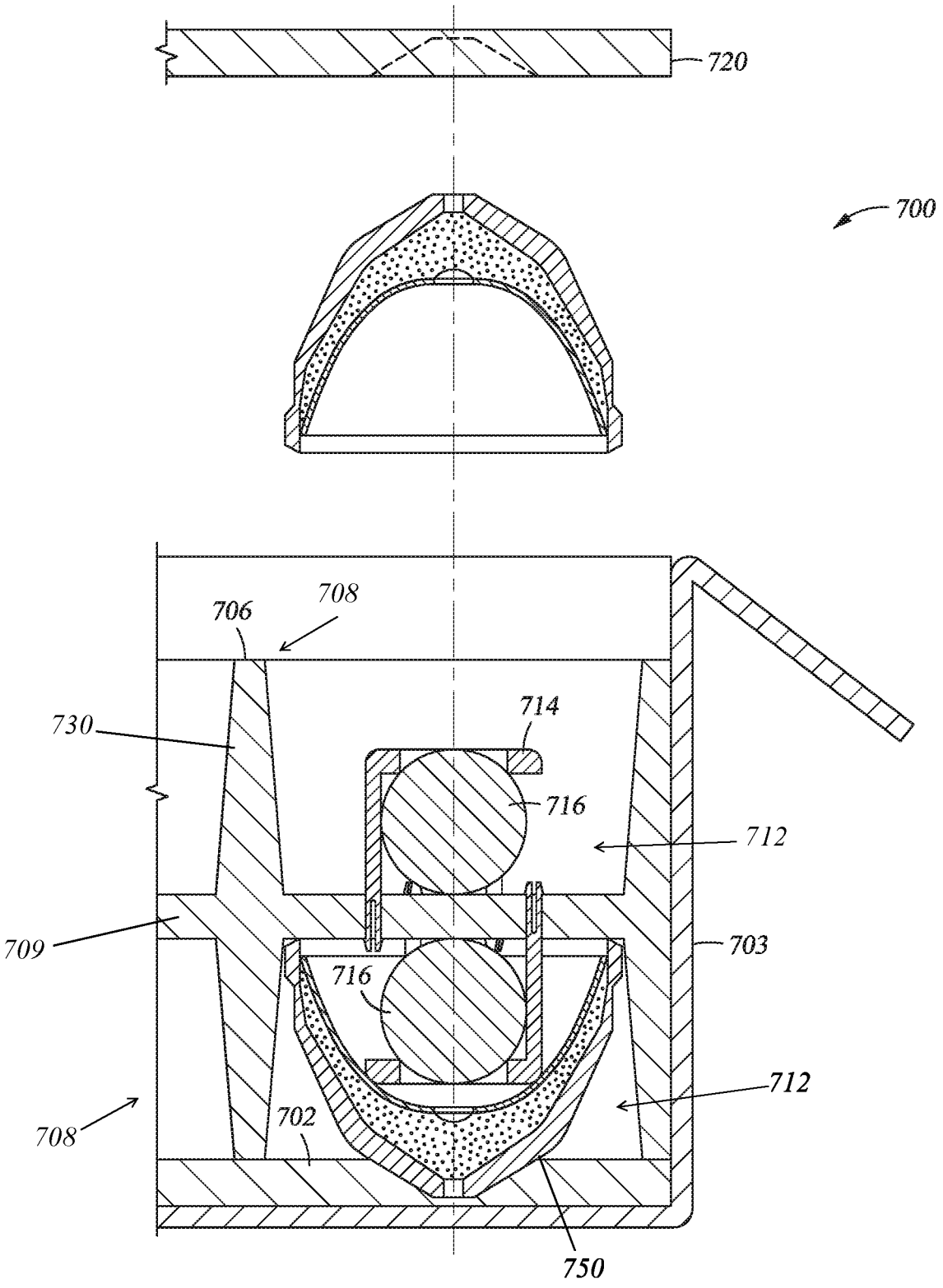
FIG. 5B is a cross-sectional view of a portion of the packaging system of FIG. 5A.

FIG. 5B is a partially-exploded cross-sectional view of a portion of the packaging system 700. As described above, the attenuator frame 706 defines two partition portions 708, top and bottom. Walls 730 of the partition portions 708 define the receptacles 712 into which a shaped charge 750 is placed. Two shaped charges 750 are shown in the orientation they will assume when placed in the receptacles 712. The shaped charge 750 at the top is shown exploded from the packaging structure 700 to illustrate placing the shaped charge 750 into the receptacle 712. As described above, the partition portion 708 are separated by a containment plate 709.

A cage 714 is deployed in each receptacle 712 to hold an attenuator 716, which in this case is a simple hard, dense, spherical object, such as a hardened steel ball large enough to be captured within the cage 714. As in FIG. 4E, the cage 714 houses the steel ball for positioning in the cavities of the shaped charges 750 to be packaged in the packaging system 700. The cages 714, in this case, are separate pieces that fit to the containment plate 709, for example by securely inserting into one or more openings of the containment plate 709. An attenuator 716 is positioned in a receptacle 712 of the attenuator frame 706, and a cage 714 is installed over the attenuator 716 and engaged with the containment plate 709.

Before the attenuator frame 706 is fitted to the bottom tray 702, attenuators 716 are loaded the receptacles 712 of one partition portion 708 of the attenuator frame 706, and cages 714 are installed to hold the attenuators 716. When the attenuator frame 706 is then fitted to the bottom tray 702, the loaded attenuators 716 are deployed in the cavities of each shaped charge 750 placed on the bottom tray 702, while the shaped charges therein are securely held in place by the depressions 704. The partitions 710 and the cages 714, with installed attenuators 716 help to contain and mitigate energy release in the event the shaped charge 750 discharges.

After placement of the attenuator frame 706 onto the bottom tray 702, attenuators are then loaded into the receptacles 712 on the top side of the attenuator frame 706, cages 714 are installed, and shaped charges 750 are placed, wide end down, into the cubicles 712 on the top side of the attenuator frame 706. As shown in FIG. 5B, the shaped charges 750 are installed in the receptacles 712 facing each other, with the containment plate 709 separating the opposing shaped charges 750. One or more outer containment plates 720 are then placed over the attenuator frame 706 to close the top receptacles 712. Any number of covers can then be placed over the packaging system 700, if desired, before closing the shipping container. In this way, the shaped charges are packaged with wide ends facing each other, surrounded by a containment structure defined by the attenuator frame 706, including the partitions 710 and the containment plate 709, and the outer containment plate 720, and with attenuators deployed in the cavity of each shaped charge. It should be noted that the outer containment plate 720 adjacent to the shaped charge 750 may be identical to the bottom tray 702, with depressions (shown in phantom) to receive the narrow ends of shaped charges 750 in the top partition portion 708.

As noted above, the attenuator frame 706 can be molded as a single piece of plastic, which can be fiber reinforced for extra strength (any of the parts described herein as being optionally made of plastic can be fiber reinforced). If undamaged during shipment, the molded plastic attenuator frame 706 and cages 714 can be reused. Alternately, the parts of the attenuator frame 706 can be implemented as separate pieces. For example, the partition portions 708 can be separate pieces made of any suitable material, such as plastic, cardboard, wood, or the like. The containment plate 709 can also be a separate piece, made of similar materials. It should be noted that the partitions 710 described in connection with FIGS. 5A and 5B can be hollow walls like those shown in FIG. 3.

Figure 6:
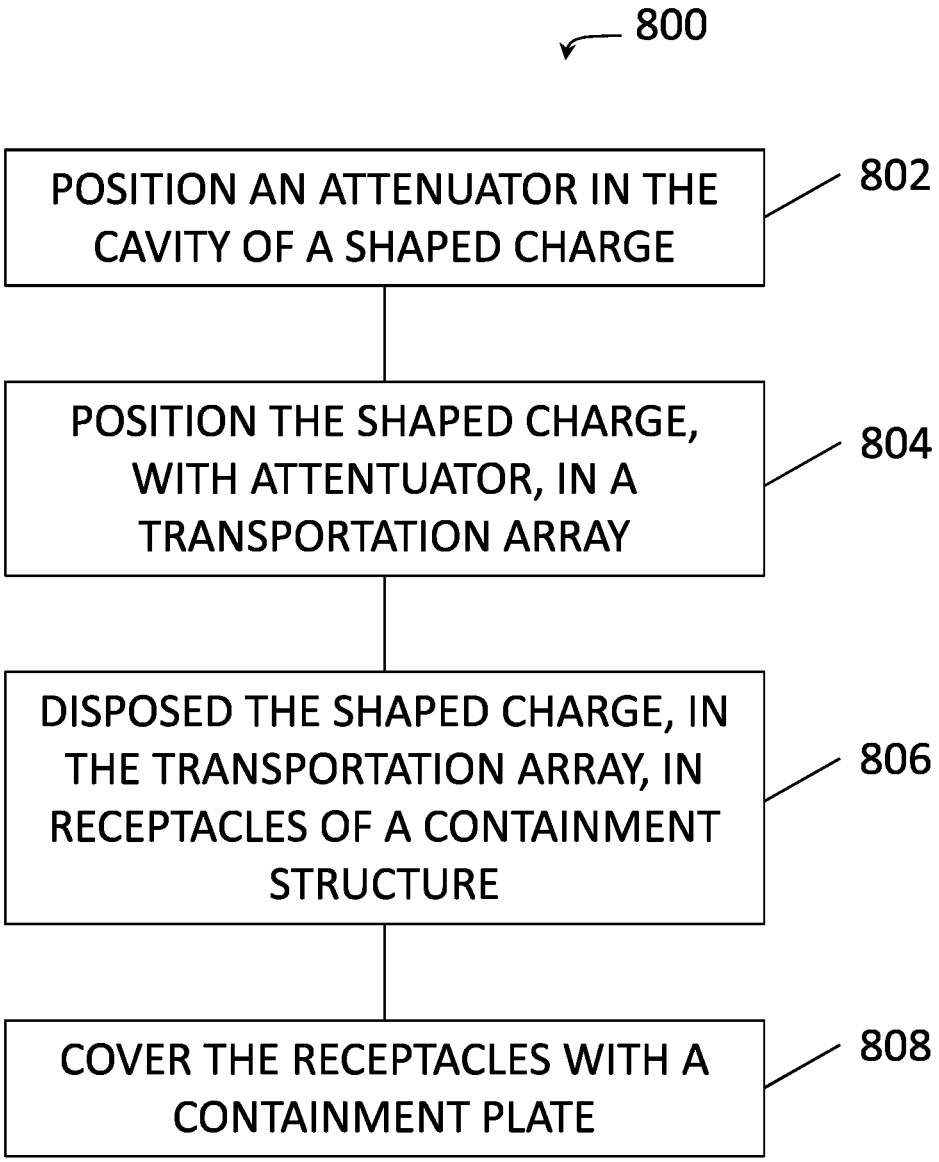
FIG. 6 is a flow diagram summarizing a method according to one embodiment.

FIG. 6 is a flow diagram summarizing a method 800 of safely transporting shaped charges. At 802, an attenuator is positioned within the cavity defined by the concave surface of a shaped charge. The attenuator is a dense, hard object, like any of the attenuators or interrupters described elsewhere herein, that withstands the energy discharged by activation of the shaped charge to prevent propagation of that energy in sufficient intensity to activate a neighboring charge. The attenuator can rest on the concave surface of the cavity or be suspended inside the cavity and supported from the edge of the cavity.

At 804, the shaped charge is positioned in a transportation array with the wide ends of the shaped charges facing each other in the transportation array. The attenuator is also positioned in the transportation array. Here, "transportation array" refers to a configuration or arrangement for transportation. The attenuator may be positioned in the cavity of the shaped charge before or after placing the shaped charge in the transportation array. For example, in the embodiment of FIG. 3, the attenuator is placed in the cavity of the shaped charge before the shaped charge, with installed attenuator, is placed in the transportation array. In the embodiment of FIG. 5A, however, the shaped charge is placed in the transportation array, with attenuator, before the attenuator is installed in the cavity of the shaped charge. In either case, the attenuators of two shaped charges are positioned adjacent to one another, so that the activation of one shaped charge is essentially contained by two attenuators. A containment plate can be positioned between the two facing attenuators, if desired. The attenuators can be attached to the containment plate or held adjacent to the containment plate by restraints such as cages, as described above.

At 806, the shaped charges are disposed into receptacles defined by a containment structure. The containment structure may include a partition tray, but in any case, each receptacle holds one shaped charge such that propagation of any energy release from activation of one shaped charge is further resisted by the containment structure. As noted above, the attenuator may be installed prior to disposing the shaped charges in the receptacles, or the attenuator may be pre-positioned in the receptacle before disposing the shaped charge into the receptacle, for example by using a restraint to position the attenuator in the cavity of the shaped charge when the shaped charge is disposed in the receptacle. Alternately, the attenuator can be attached to a wall of the receptacle, such as a containment plate, to project into the cavity of the shaped charge.

In general, operations 802, 804, and 806 can be performed in any order in different embodiments. For example, in the embodiment of FIG. 7A, some shaped charges are placed into receptacles before attenuators are positioned in the cavities of the shaped charges. In the embodiment of FIG. 3, attenuators are positioned in the cavities of the shaped charges before the shaped charges are placed into receptacles. In the embodiment of FIG. 7A, some shaped charges are placed into a transportation array before being placed in receptacles. Depending on the embodiment, operations 802, 804, and 806 may occur in any order.

At 808, one or more outer containment plates can be used to cover the receptacles of the containment structure. The containment plates can be any shock absorbent material to further contain and resist propagation of energy release from activation of a shaped charge.

While the foregoing is directed to embodiments, other and further embodiments of the present disclosure may be devised without departing from the basic scope thereof, and the scope thereof is determined by the claims that follow. Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

The invention claimed is:

1. A shaped charge, comprising:

a case;

an energetic material disposed in the case;

a metallic liner with a first surface disposed in contact with the energetic material and a second surface that is opposite from the first surface, and that defines a cavity; and an attenuator disposed in the cavity, wherein the attenuator comprises (1) a body made of a material selected from the group consisting of cement, concrete, and plastic, and (2) one or more metallic balls embedded within the body.

2. The shaped charge of claim 1, wherein the attenuator rests in the cavity in contact with the second surface.

3. The shaped charge of claim 1, wherein the attenuator is suspended in the cavity from an edge of the cavity.

4. The shaped charge of claim 1, wherein the one or more metallic balls are made of a material selected from the group consisting of hardened steel, gold, platinum, and tungsten.

5. The shaped charge of claim 1, wherein the one or more metallic balls include a plurality of hardened steel balls.

6. The shaped charge of claim 1, wherein the one or more metallic balls include only one metallic ball disposed in a central axial area within the body.

7. The shaped charge of claim 1, wherein the material of the body is cement or concrete.

8. The shaped charge of claim 1, wherein the material of the body is plastic, and the plastic is selected from the group consisting of Kevlar, polypropylene, polyethylene, and hard rubber.

9. A shaped charge, comprising:

a case;

an energetic material disposed in the case;

a metallic liner with a first surface disposed in contact with the energetic material and a second surface that is opposite from the first surface, and that defines a cavity; and an attenuator comprising (1) a body made of a material comprising at least one of cement, concrete, and plastic, and (2) one or more metallic balls disposed within the body.

10. The shaped charge of claim 9, wherein each of the metallic balls has a Rockwell hardness of at least about C60.

11. The shaped charge of claim 9, wherein the one or more metallic balls include only one metallic ball disposed in a central axial area within the body.

12. The shaped charge of claim 9, wherein the one or more metallic balls include a plurality of metallic balls.

13. The shaped charge of claim 9, wherein each of the one or more metallic balls is made of material selected from the group consisting of hardened steel, gold, platinum, and tungsten.

14. The shaped charge of claim 9, wherein the material of the body comprises cement or concrete.

15. The shaped charge of claim 9, wherein the one or more metallic balls comprise a hardened steel.

16. The shaped charge of claim 9, wherein the material of the body comprises the plastic.

17. The shaped charge of claim 16, wherein the plastic comprises a shock-resistant plastic including at least one of Kevlar, polypropylene, polyethylene, and hard rubber.

18. The shaped charge of claim 9, wherein each of the one or more metallic balls comprises a spherical object.

19. A shaped charge, comprising:

a case;

an energetic material disposed in the case;

a metallic liner with a first surface disposed in contact with the energetic material and a second surface that is opposite from the first surface, and that defines a cavity; and a heterogeneous attenuator disposed in the cavity and occupying at least 50% of the volume of the cavity, wherein the heterogeneous attenuator comprises (1) a body made of a material selected from the group consisting of cement, concrete, and plastic, and (2) one or more metallic balls embedded within the body.

20. The shaped charge of claim 19, wherein the material of the body includes cement or concrete, and the one or more metallic balls include only one metallic ball disposed in a central axial area within the body.

* * * * *